US010947966B2

(12) United States Patent
Stacey et al.

(10) Patent No.: US 10,947,966 B2
(45) Date of Patent: Mar. 16, 2021

(54) PERISTALTIC PUMP WITH CONTROLLED STOP

(71) Applicant: Haemonetics Corporation, Braintree, MA (US)

(72) Inventors: Gary Stacey, Marshfield, MA (US); Edward Kaleskas, North Falmouth, MA (US)

(73) Assignee: Haemonetics Corporation, Boston, MA (US)

( * ) Notice: Subject to any disclaimer, the term of this patent is extended or adjusted under 35 U.S.C. 154(b) by 137 days.

(21) Appl. No.: 15/769,174

(22) PCT Filed: Oct. 21, 2016

(86) PCT No.: PCT/US2016/058177
§ 371 (c)(1),
(2) Date: Apr. 18, 2018

(87) PCT Pub. No.: WO2017/070508
PCT Pub. Date: Apr. 27, 2017

(65) Prior Publication Data

US 2018/0313348 A1 Nov. 1, 2018

Related U.S. Application Data

(60) Provisional application No. 62/244,405, filed on Oct. 21, 2015.

(51) Int. Cl.
*F04B 49/02* (2006.01)
*F04B 43/12* (2006.01)
(Continued)

(52) U.S. Cl.
CPC ..... *F04B 49/02* (2013.01); *F04B 43/1253* (2013.01); *F04B 49/06* (2013.01); *F04B 49/10* (2013.01)

(58) Field of Classification Search
CPC .... F04B 43/082; F04B 43/1253; F04B 49/02; F04B 49/06; F04B 49/10
(Continued)

(56) References Cited

U.S. PATENT DOCUMENTS 3,138,104 A 6/1964 Theodore
3,542,491 A 11/1970 Newman
(Continued)

FOREIGN PATENT DOCUMENTS

GB 2 425 471 11/2006
GB 2 435 596 8/2007
(Continued)

OTHER PUBLICATIONS

USPTO as the International Searching Authority, Authorized Officer: Shane Thomas, International Search Report and Written Opinion of the International Searching Authority, PCT/US16/58177, dated Jan. 13, 2017, 15 pages.
(Continued)

*Primary Examiner* — Connor J Tremarche
(74) *Attorney, Agent, or Firm* — Sunstein LLP

(57) ABSTRACT

A peristaltic pump includes a rotor and first and second rollers mounted on the rotor. The first and second rollers rotate between a disengaged, initially engaged and a fully engaged position with respect to a section of tubing. The rollers begin to occlude the tubing when in the initially engaged positon and fully occlude the tubing when in the fully engaged position. The pump also includes an encoder and a rotor controller. The encoder monitors the position of the first and second rollers as the rotor rotates. The rotor controller is in electrical communication with the encoder and controls the operation of the pump and rotor. The controller stops the rotation of the rotor in response to a stop command and based upon the monitored position of the first
(Continued)

and second rollers such that either the first or second roller remains in the fully engaged positon.

27 Claims, 3 Drawing Sheets

(51) Int. Cl.
*F04B 9/06* (2006.01)
*F04B 49/10* (2006.01)
*F04B 49/06* (2006.01)

(58) Field of Classification Search
USPC ..... 417/477.1
See application file for complete search history.

(56) References Cited

U.S. PATENT DOCUMENTS

| | | | | |
|---|---|---|---|---|
| 4,564,342 | A | 1/1986 | Weber et al. | |
| 4,715,786 | A | 12/1987 | Wolff et al. | |
| 5,003,239 | A * | 3/1991 | Matthews | F04B 43/09 318/565 |
| 5,215,450 | A | 6/1993 | Tamari | |
| 5,263,831 | A | 11/1993 | Kappus | |
| 5,649,808 | A | 7/1997 | Gruszecki et al. | |
| 6,102,678 | A | 8/2000 | Peclat | |
| 6,749,410 | B1 | 6/2004 | Burch | |
| 2005/0019185 | A1 | 1/2005 | Otis | |
| 2005/0047925 | A1 * | 3/2005 | Davis | B41J 2/17596 417/53 |
| 2010/0036486 | A1 * | 2/2010 | Mazur | A61M 1/1037 623/3.13 |
| 2011/0200458 | A1 * | 8/2011 | Baruzzi | F04B 43/1253 417/53 |
| 2013/0189120 | A1 | 7/2013 | Nelson et al. | |

FOREIGN PATENT DOCUMENTS

| | | |
|---|---|---|
| WO | WO 94/15658 | 7/1994 |
| WO | WO 01/18394 | 3/2001 |
| WO | WO 2009/105436 | 8/2009 |

OTHER PUBLICATIONS

European Patent Office, Extended European Search Report, application No. 16858319.3, dated Apr. 29, 2019, 10 pages.
European Patent Office, European Examination Report, application No. 16858319.3, dated Mar. 12, 2020, 5 pages.

* cited by examiner

PERISTALTIC PUMP WITH CONTROLLED STOP

PRIORITY

This patent application claims priority from United States Provisional Application Ser. No. 62/244,405, filed Oct. 21, 2015, entitled "Peristaltic Pump with Controlled Stop,", and naming Gary Stacey and Edward Kaleskas as inventors, the disclosure of which is incorporated herein, in its entirety by reference.

TECHNICAL FIELD

The present invention relates to peristaltic pumps, and more particularly to the controlled stopping of peristaltic pumps

BACKGROUND ART

Peristaltic pumps are used in a wide variety of applications to move fluid through tubing. In such applications, the flexible tubing may be installed into the pump (or tubing may be connected to a section of tubing already installed in the pump) and a rotor with a number of rollers or similar structures (e.g., lobes, wipers, etc.) compress the flexible tube. As the rotor turns, the rollers occlude the tubing and force the fluid through the tubing. To that end, the pumps are typically designed to have one roller engage and occlude the tubing before the other roller disengages. However, in some instances, the tolerances of the tubing, the geometry of the pump housing, and the position of the rollers may allow flow to bypass the rollers when the pump is stopped.

SUMMARY OF THE EMBODIMENTS

In accordance with one embodiment of the invention, a peristaltic pump includes a pump body configured to receive a section of tubing, and a rotor configured to rotate about an axis. The pump may also include a first roller mounted on a first end of the rotor and a second roller mounted on a second end of the rotor. The first roller may rotate between a disengaged, initially engaged and a fully engaged position with respect to the section of tubing as the rotor rotates. The first roller may start to occlude the section of tubing when in the initially engaged positon and fully occlude the section of tubing when in the fully engaged position. The second roller may also rotate between a disengaged, initially engaged and a fully engaged position with respect to the section of tubing as the rotor rotates. The second roller may start to occlude the section of tubing when in the initially engaged positon and fully occlude the section of tubing when in the fully engaged position.

The pump may also include an encoder and a rotor controller. The encoder may be located on the rotor and may monitor the position of the first and second rollers as the rotor rotates about the axis. The rotor controller may be in electrical communication with the encoder and may control the operation of the pump and rotor. The rotor controller may be configured to stop the rotation of the rotor in response to a stop command and based upon the monitored position of the first and second rollers such that either the first or second roller remains in the fully engaged positon. The first roller may rotate about a first roller axis as the first roller transitions between the initially engaged, fully engaged and disengaged positions. The second roller may rotate about a second roller axis as the second roller transitions between the initially engaged, fully engaged and disengaged positions.

In some embodiments, the pump may include a platen, and at least a portion of the section of tubing may be located between the platen and the first roller when the first roller is in the initially engaged and fully engaged positions. The first roller may press the section of tubing against the platen to fully occlude the tubing when the first roller is in the fully engaged position. Additionally or alternatively, a portion of the section of tubing may be located between the platen and the second roller when the second roller is in the initially engaged and fully engaged positions. The second roller may press the section of tubing against the platen to fully occlude the tubing when the second roller is in the fully engaged position.

The second roller may be in the disengaged position when the first roller is in the fully engaged position, and/or the first roller may be in the disengaged position when the second roller is in the fully engaged position. Additionally or alternatively, the first roller may be in an initially disengaged position when the second roller is in the initially engaged position, and/or the second roller may be in an initially disengaged position when the first roller is in the initially engaged position. The rotor may include a driving shaft, and the encoder may be located on the driving shaft.

In accordance with further embodiments, a method may include providing a peristaltic pump. The peristaltic pump may have a pump body, a rotor configured to rotate about an axis, a first roller mounted on a first end of the rotor, and a second roller mounted on a second end of the rotor. The method may also include inserting a section of tubing into the peristaltic pump, and rotating the rotor about the axis. The rotation of the rotor may cause the first and second rollers to transition between a disengaged, initially engaged and a fully engaged position with respect to the section of tubing. The method may then (1) receive, in a pump controller, a stop command instructing the pump controller to stop the pump, and (2) monitor, using an encoder located on the rotor, the position of the first and second rollers as the rotor rotates about the axis. The method may then stop the pump, using the pump controller, based upon the position of the first and second rollers such that either the first or second roller remains in the fully engaged positon.

In some embodiments, the first roller may rotate about a first roller axis as the first roller transitions between the initially engaged, fully engaged and disengaged positions. Similarly, the second roller may rotate about a second roller axis as the second roller transitions between the initially engaged, fully engaged and disengaged positions. The pump may also include a platen, and at least a portion of the section of tubing may be located between the platen and the first or second roller when the first or second roller is in the initially engaged and fully engaged positions. The first and/or second rollers may press the section of tubing against the platen to occlude the tubing when the first/second roller is in the fully engaged position. In further embodiments, the second roller may be in the disengaged position when the first roller is in the fully engaged position and/or the first roller may be in the disengaged position when the second roller is in the fully engaged position.

The rotor may include a driving shaft and the encoder may be located on the driving shaft. The first roller may be in an initially disengaged position when the second roller is in the initially engaged position, or the second roller may be in an initially disengaged position when the first roller is in the initially engaged position. The first and second rollers start to occlude the section of tubing when in the initially engaged positon and fully occlude the section of tubing when in the fully engaged position.

In accordance with still further embodiments, a peristaltic pump may include a pump body configured to receive a section of tubing, a rotor configured to rotate about an axis, a first roller and a second roller. The first roller may be mounted on a first end of the rotor and may rotate about a first roller axis. The first roller may selectively engage and disengage the section of tubing and roll along the surface of the tubing as the rotor rotates. The second roller may be mounted on a second end of the rotor and may rotate about a second roller axis. The second roller may selectively engage and disengage the section of tubing and roll along the surface of the tubing as the rotor rotates.

The pump may also include an encoder and a rotor controller. The encoder may be located on the rotor (e.g., on a driving shaft of the rotor) and may monitor the position of the first and second rollers as the rotor rotates about the axis. The rotor controller may be in electrical communication with the encoder and may control the operation of the pump and rotor. For example, to prevent fluid bypass, the rotor controller may stop the rotation of the rotor based upon the monitored position of the first and second rollers such that the first or second roller engages and fully occludes the section of tubing.

The pump may also include a platen, and the section of tubing may be located between the platen and the first roller when the first roller engages the section of tubing and/or between the platen and the second roller when the second roller engages the section of tubing. The first roller may press the section of tubing against the platen to occlude the tubing as first roller rolls along the surface of the tubing. Similarly, the second roller may press the section of tube against the platen to occlude the tubing as second roller rolls along the surface of the tubing.

BRIEF DESCRIPTION OF THE DRAWINGS

The foregoing features of embodiments will be more readily understood by reference to the following detailed description, taken with reference to the accompanying drawings, in which.

DETAILED DESCRIPTION OF SPECIFIC EMBODIMENTS

In illustrative embodiments, a peristaltic pump with controlled stop may have a rotor with a roller or similar structure at either end of the rotor. During operation of the pump, the rotor may rotate about an axis to selectively engage and disengage the rollers with the tubing, causing the tubing to become occluded. To prevent liquid bypass when the pump is stopped, various embodiment of the present invention may monitor the location of the rollers prior to stopping the pump to ensure that at least one of the rollers fully occludes the tubing.

Figure 1:
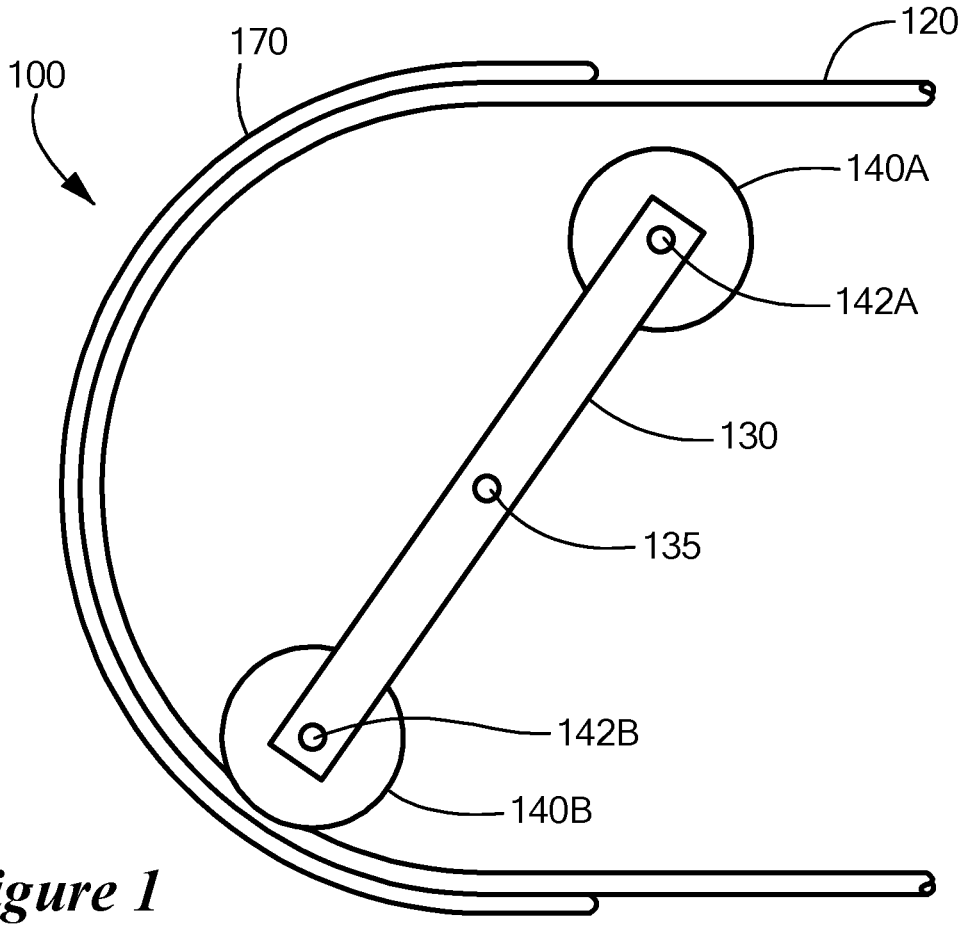
FIG. 1 schematically shows a top view of a peristaltic pump with tubing installed in the pump, in accordance with various embodiments of the present invention.

FIG. 1 shows a two-roller peristaltic pump 100 in accordance with some embodiments of the present invention. The peristaltic pump 100 may include a housing 110 (FIG. 2) that defines the structure pump 100, houses many of the components of the pump 100 and into which a section of tubing 120 may be inserted/installed. Additionally, the pump 100 also includes a rotor 130 and two rollers 140A/B located at and secured to either end of the rotor 130. As discussed in greater detail below, during operation of the pump 100, the rotor 130 will rotate about a rotor axis 135, causing each of the rollers 140A/B to selectively engage and disengage with the tubing 120. This, in turn, causes the fluid within the tubing 120 to be forced through the tubing 120 (e.g., by peristalsis).

To facilitate the rotation of the rotor 110 and the operation of the pump 100, the pump 100 may include a rotor motor 150 that is mechanically connected/coupled to the rotor 110 via a drive shaft 160. To that end, as the motor 150 energizes, the rotational force from the motor 150 will be translated to the rotor 110 via the drive shaft 160. This, in turn, will cause the rotor 110 to rotate, bringing the rollers 140A/B into and out of engagement with the tubing 120 as the rotor 110 rotates.

It should be noted that the friction created between the rollers 140A/B and the tubing 120 when the rollers 140A/B engage with the tubing may be problematic. For example, the friction may cause the rollers 140A/B to pull/tug on the tubing 120 and increase the force required for the rollers 140A/B to move over the tubing 120. To that end, the rollers 140A/B can independently rotate about their respective roller axes (e.g. about points 142A/B in FIG. 1) while they are engaged with and move along the section of tubing 110. This reduces the force required to rotate the rotor 130 and helps to improve pump efficiency.

As mentioned above, as the rotor 130 rotates and the rollers 140A/B engage the tubing 120, the rollers 140A/B occlude the tubing 120 to create the peristalsis required for pump operation. To provide a solid/rigid surface against which the rollers 140A/B can deform the tubing 120 (e.g., to occlude the tubing 120), the pump 100 may include a platen 170. As best shown in FIG. 1, when installed within the pump 100, a portion of the tubing 120 may be located between the platen 170 and the rotor 130 (and the roller(s) 140A/B contacting the tubing 120). In such embodiments, as the rotor 130 rotates and the rollers 140A/B engage and move along the length of the tubing 170, the rollers 140A/B will deform the tubing 120 against the platen 170, thereby occluding the tubing 170, for example, at the point of contact with the roller 140A/B.

The operation of the pump 100 may be controlled by a pump controller 180. For example, the pump controller 180 may be in communication with the motor 160 and start and stop the motor 160 (and therefore the pump) upon receipt of a start command and stop command, respectively. Alternatively, if the pump 100 is used in conjunction with an additional piece of equipment, the operation of the pump may be controlled the additional equipment. For example, if the pump 100 is part of a blood processing system (e.g., if the pump is used to control the flow of whole blood, blood components, anticoagulant, etc. through the blood processing system), a controller within the blood processing system may control the operation of the pump 100 and act as the pump controller.

Figure 3:
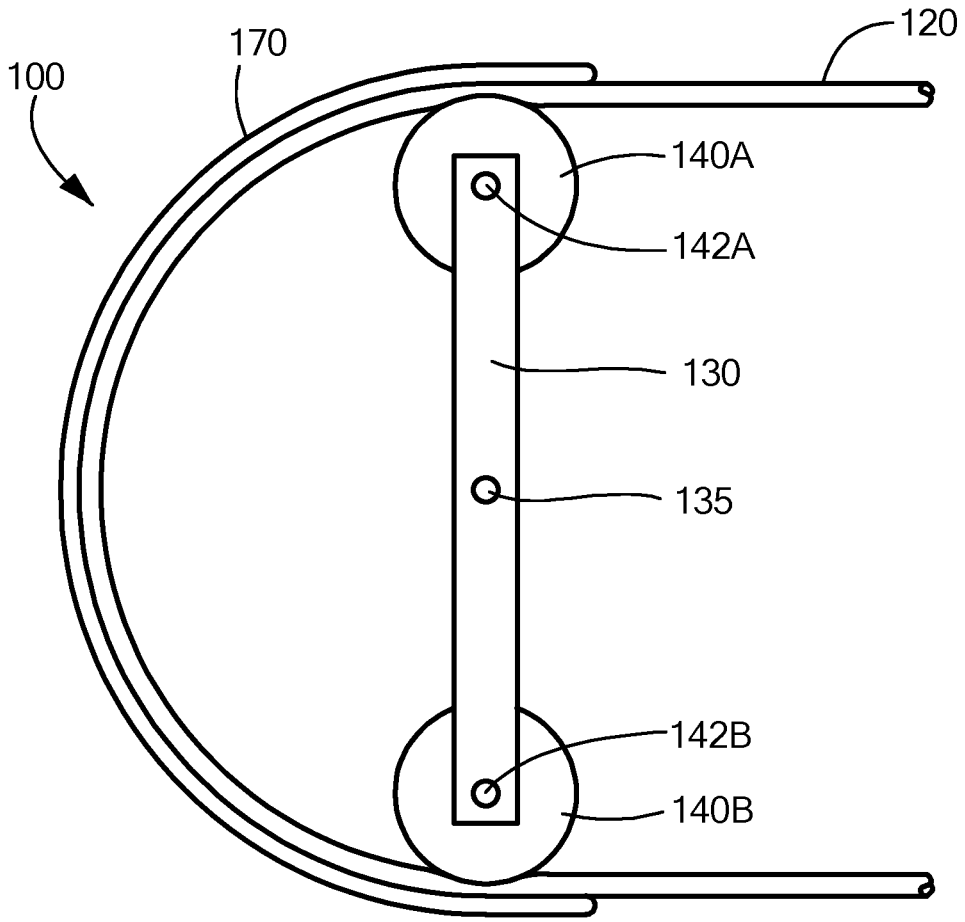
FIG. 3 schematically shows a top view of the peristaltic pump in FIG. 1 with one roller beginning to engage the tubing and the other roller beginning to disengage the tubing, in accordance with various embodiments of the present invention.

During operation and as the rotor 130 rotates, each of the rollers 140A/B will engage and disengage the tubing 120. For example, as the rotor 130 rotates, the rollers 140A/B will initially engage the tubing 120 when they first reach the platen 170 and begin to compress/occlude the tubing 120 against the platen 170 (e.g., roller 140B in FIG. 3). As the rotor 130 continues to rotate, the rollers 140A/B will fully engage the tubing 120 (e.g., roller 140B in FIG. 1). In the fully engaged position, the rollers 140A/B (e.g., the roller in contact with the tubing 120) fully occlude the tubing 120 by compressing the tubing 120 against the platen 170. The rollers 140A/B will then continue to roll along the surface of the tubing 120 until the roller 140A/B reaches the end of the platen 170. At this point, the roller 140A/B will begin to disengage from the tubing 120 (e.g., the roller 140A/B will be in an initially disengaged position; roller 140A in FIG. 3). Once the roller 140A/B passes the end of the platen 170, the roller 140A/B will be fully disengaged from the tubing 120 (e.g., roller 140A in FIG. 1) and will no longer occlude the tubing 120.

It should be noted that, although the dimensions and tolerances of the platen geometry, roller 140A/B rotation, and tubing 120 size are tightly controlled for many applications (including blood processing applications), in some instances, the rollers 140A/B may not fully occlude the tubing 120 when they initially engage and/or initially disengage from the tubing 120. Therefore, if the pump 120 happens to stop when in this position (e.g., in the configuration shown in FIG. 3), the tubing diameter or durometer of the tubing may prevent the rollers 140A/B from fully occluding the tubing 120 and may allow some fluid to pass by one or both of the rollers 140A/B. Depending on the application, this fluid bypass of the stopped pump may be highly problematic. For example, in blood processing applications, the fluid bypass may allow saline or anticoagulant to flow when not appropriate and/or when not prescribed by the blood processing protocol. This, in turn, may put the patient at risk (e.g., if too much anticoagulant is returned to the patient/donor) and/or negatively impact the blood processing procedure.

Figure 2:
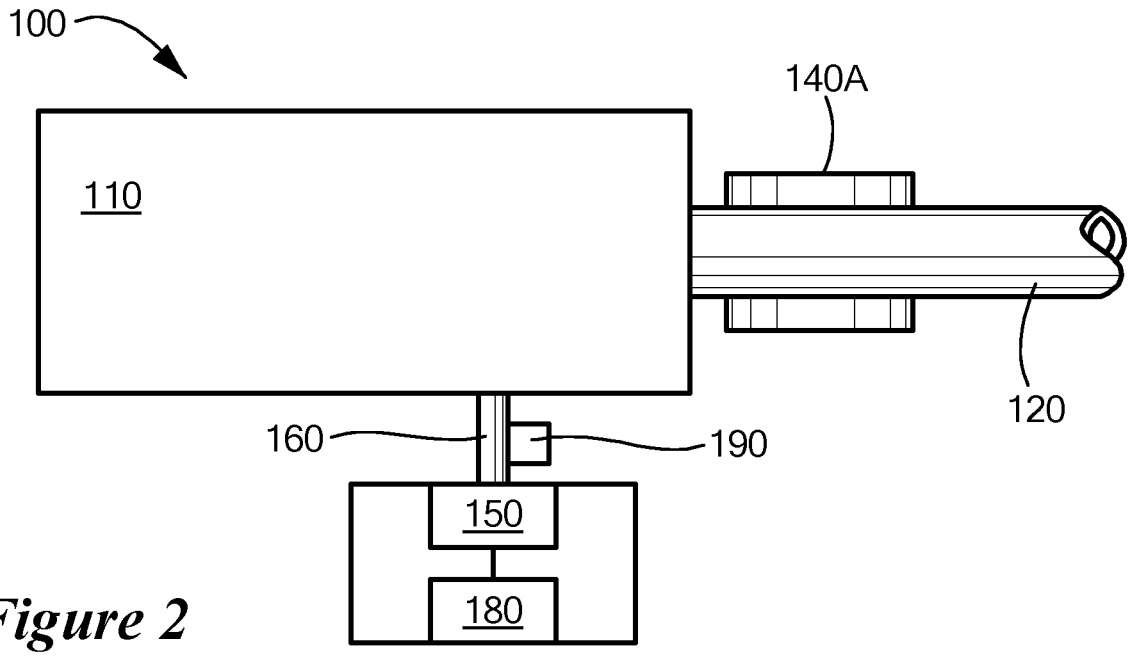
FIG. 2 schematically shows a side view of the peristaltic pump shown in FIG. 1, in accordance with various embodiments of the present invention.

To prevent the bypass discussed above, some embodiments of the present invention may control the stoppage of the pump 100 to ensure that at least one of the rollers 140A/B is fully engaged with and fully occludes the tubing 120. To that end, some embodiments of the present invention may include a position sensor (e.g., an encoder 190; FIG. 2) that is located on the drive shaft 160 and in electrical communication with the controller 180. In such embodiments, the encoder 190 may monitor the absolute position of each of the rollers 140A/B as the rotor 130 rotates. The controller 180 may then receive the position information from the encoder 190 and control the stoppage of the pump to ensure that at least one of the rollers 140A/B is in full engagement with and is fully occluding the tubing (e.g., at least one of the rollers 140A/B is in the position shown by roller 140B in FIG. 1). Therefore, in some embodiments, the controller, even upon receipt of a stop command, will continue to allow the pump to operate (e.g., the rotor to rotate) until one of the rollers 140A/B is in full engagement with and is fully occluding the tubing 120. Then, once one of the rollers 140A/B is in fully engagement, the controller 180 may stop the pump.

It should be noted that, although the position sensor (e.g., the encoder 190) is discussed above as being located on the drive shaft 160, the encoder 190 may be located anywhere in the system that allows the encoder 190 to monitor the position of each of the rollers 140A/B as they rotate. For example, the encoder 190 may be located on/within the motor 150 (e.g., it may be part of the motor 150). Additionally or alternatively, the encoder may be located on rotor 130.

Figure 4:
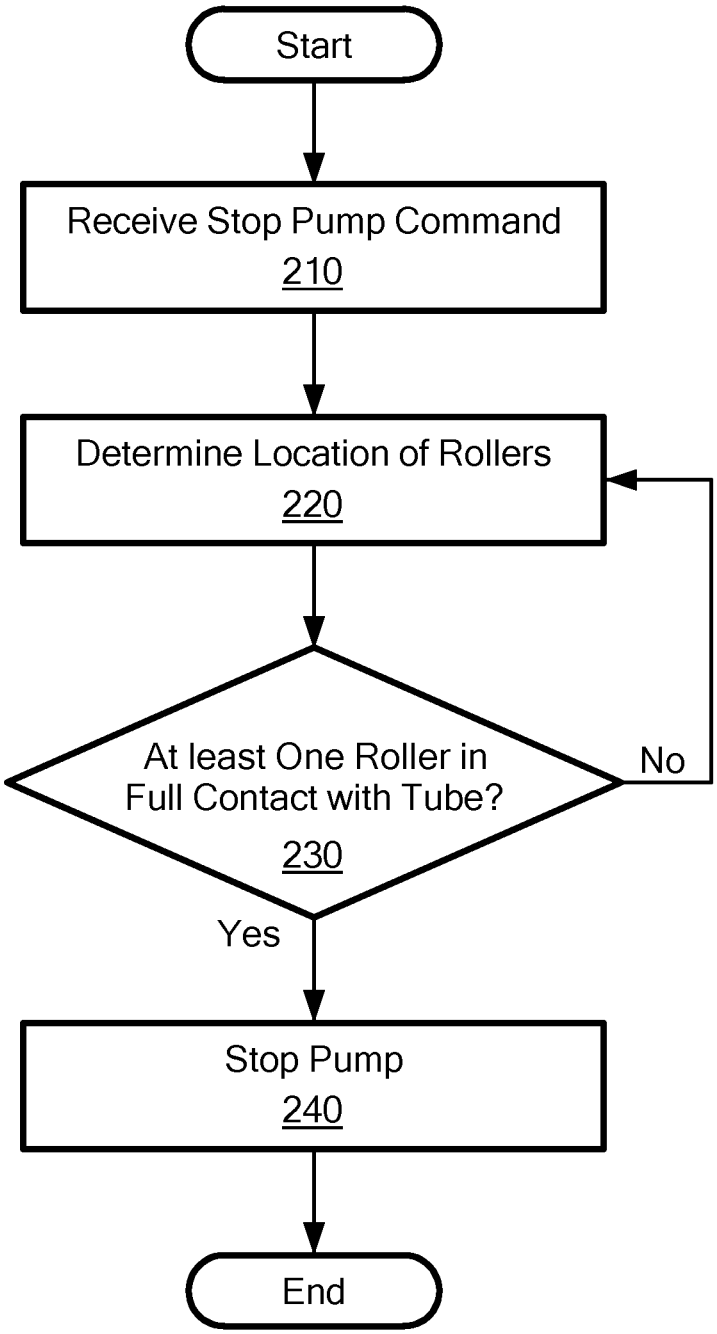
FIG. 4 is a flowchart depicting a method of controlling the operation of a peristaltic pump during stopping, in accordance with some embodiments of the present invention.

FIG. 4 is a flowchart depicting a method of controlling the stoppage of a pump 100, in accordance with some embodiments of the present invention. First, while the pump 100 is running and pumping fluid, the pump controller 180 may receive a stop command instructing the controller 180 to stop the pump 100 (Step 210). The stop command may come from a user (e.g., by the user pressing a stop button on a control panel of the pump 100 or related equipment). Additionally or alternatively, the stop command may originate from any additional equipment/systems with which the pump 100 is being used. For example, for pumps used in conjunction with blood processing systems, the blood processing system may send the stop command to the pump controller 180 in response to a user command or automatically based upon the blood processing protocol.

As mentioned above, the encoder 190 monitors the positions of the rollers 140A/B during pump operation and helps to ensure that the pump stops when at least one of the rollers 140A/B is fully engaged with and fully occludes the tubing 120. Therefore, once the pump 100 receives the stop command, the pump 100 (e.g., the pump controller 180 and encoder 190) monitors the position of the rollers 140A/B with respect to the tubing 120 (Step 220) and determines if at least one of the rollers 140A/B is fully engaged and fully occludes the tubing 120 (Step 230). If at least one of the rollers 140A/B is fully engaged with the tubing 120, the controller 180 will stop the pump 120 (Step 240). If neither roller 140A/B is fully engaged with tubing 120 (e.g., they are fully disengaged, initially engaged or initially disengaged), the controller 180 will keep the pump running and will continue to monitor the positions of the rollers 140A/B until at least one of the rollers 140A/B is fully engaged. The controller 180 will then stop the pump 100.

It should be noted that, although pumps 100 having two rollers 140A/B are discussed above, embodiments of the present invention can have more than two rollers 140A/B. For example, some embodiments of the present invention may have three or more rollers located on the rotor 130. Additionally or alternatively, instead of rollers 140A/B, some embodiments may utilize lobes, wipers, etc. to engage with and occlude the tubing 120 during pump operation. In such embodiments, the controller 180 will keep the pump running and will monitor the position of the rollers, lobes, wipers, etc. until one of the rollers, lobes, wipers, etc. fully engages and occludes the tubing 120.

The embodiments of the invention described above are intended to be merely exemplary; numerous variations and modifications will be apparent to those skilled in the art. All such variations and modifications are intended to be within the scope of the present invention as defined in any appended claims.

What is claimed is:

1. A peristaltic pump comprising:

a pump body configured to receive a section of tubing;

a rotor configured to rotate about an axis, the rotor having a first roller and second roller and having no more than two rollers;

the first roller mounted on a first end of the rotor and configured to rotate between a disengaged, initially engaged and a fully engaged position with respect to the section of tubing as the rotor rotates, the first roller configured to begin to occlude the section of tubing when in the initially engaged position and fully occlude the section of tubing when in the fully engaged position;

the second roller mounted on a second end of the rotor and configured to rotate between a disengaged, initially engaged and a fully engaged position with respect to the section of tubing as the rotor rotates, the second roller configured to begin to occlude the section of tubing when in the initially engaged position and fully occlude the section of tubing when in the fully engaged position, wherein the second roller is in the disengaged position when the first roller is in the fully engaged position, and the first roller is in the disengaged position when the second roller is in the fully engaged position;

an encoder configured to monitor the position of the first and second rollers as the rotor rotates about the axis; and a rotor controller in electrical communication with the encoder and configured to control the operation of the peristaltic pump and the rotor, the rotor controller configured to stop the rotation of the rotor in response to a stop command by determining, after receiving the stop command, whether the monitored position of either the first or second roller is in the fully engaged position, if it is determined that the monitored position of neither the first nor second roller is in the fully engaged position, re-determining whether the monitored position of either the first or second roller is in the fully engaged position, and if it is determined that the monitored position of either the first or second roller is in the fully engaged position, stopping the peristaltic pump.

2. A peristaltic pump according to claim 1, wherein the first roller is configured to rotate about a first roller axis as the first roller transitions between the initially engaged, fully engaged and disengaged positions.

3. A peristaltic pump according to claim 1, wherein the second roller is configured to rotate about a second roller axis as the second roller transitions between the initially engaged, fully engaged and disengaged positions.

4. A peristaltic pump according to claim 1, further comprising a platen, at least a portion of the section of tubing located between the platen and the first roller when the first roller is in the initially engaged and fully engaged positions.

5. A peristaltic pump according to claim 4, wherein the first roller is configured to press the section of tube against the platen thereby fully occluding the tubing when the first roller is in the fully engaged position.

6. A peristaltic pump according to claim 1, further comprising a platen, at least a portion of the section of tubing located between the platen and the second roller when the second roller is in the initially engaged and fully engaged positions.

7. A peristaltic pump according to claim 6, wherein the second roller is configured to press the section of tube against the platen thereby fully occluding the tubing when the second roller is in the fully engaged position.

8. A peristaltic pump according to claim 1, further comprising a drive shaft mechanically coupling the rotor and a rotor motor, the encoder located on the drive shaft.

9. A peristaltic pump according to claim 1, wherein the first roller is in an initially disengaged position when the second roller is in the initially engaged position.

10. A peristaltic pump according to claim 1, wherein the second roller is in an initially disengaged position when the first roller is in the initially engaged position.

11. A method comprising:

providing a peristaltic pump, the peristaltic pump having: a pump body, a rotor configured to rotate about an axis, a first roller mounted on a first end of the rotor, a second roller mounted on a second end of the rotor, the rotor having no more than two rollers;

inserting a section of tubing into the peristaltic pump;

rotating the rotor about the axis, rotation of the rotor causing the first roller to transition between a disengaged, initially engaged and a fully engaged position with respect to the section of tubing and the second roller to transition between a disengaged, initially engaged and a fully engaged position with respect to the section of tubing, wherein the second roller is in the disengaged position when the first roller is in the fully engaged position, and the first roller is in the disengaged position when the second roller is in the fully engaged position;

receiving, in a pump controller, a stop command instructing the pump controller to stop the peristaltic pump;

monitoring, using an encoder, the position of the first and second rollers as the rotor rotates about the axis; and stopping the peristaltic pump, using the pump controller, only after (i) receiving the stop command and (ii) determining that either the first or second roller is in the fully engaged position.

12. A method according to claim 11, wherein the first roller is configured to rotate about a first roller axis as the first roller transitions between the initially engaged, fully engaged and disengaged positions.

13. A method according to claim 11, wherein the second roller is configured to rotate about a second roller axis as the second roller transitions between the initially engaged, fully engaged and disengaged positions.

14. A method according to claim 11, wherein the peristaltic pump further includes a platen, at least a portion of the section of tubing located between the platen and the first roller when the first roller is in the initially engaged and fully engaged positions.

15. A method according to claim 14, wherein the first roller is configured to press the section of tube against the platen thereby fully occluding the tubing when the first roller is in the fully engaged position.

16. A method according to claim 11, wherein the peristaltic pump further includes a platen, at least a portion of the section of tubing located between the platen and the second roller when the second roller is in the initially engaged and fully engaged positions.

17. A method according to claim 16, wherein the second roller is configured to press the section of tube against the platen thereby fully occluding the tubing when the second roller is in the fully engaged position.

18. A method according to claim 11, wherein the peristaltic pump further includes a drive shaft mechanically coupling the rotor and a rotor motor, the encoder located on the drive shaft.

19. A method according to claim 11, wherein the first roller is in an initially disengaged position when the second roller is in the initially engaged position.

20. A method according to claim 11, wherein the second roller is in an initially disengaged position when the first roller is in the initially engaged position.

21. A method according to claim 11, wherein the first roller initially occludes the section of tubing when in the initially engaged position and fully occludes the section of tubing when in the fully engaged position.

22. A method according to claim 11, wherein the second roller initially occludes the section of tubing when in the initially engaged position and fully occluding the section of tubing when in the fully engaged position.

23. A peristaltic pump comprising:

a pump body configured to receive a section of tubing;

a rotor configured to rotate about an axis, the rotor having a first roller and second roller and having no more than two rollers;

the first roller mounted on a first end of the rotor and configured to rotate about a first roller axis, the first roller configured to selectively engage and disengage the section of tubing and roll along a surface of the tubing as the rotor rotates;

the second roller mounted on a second end of the rotor and configured to rotate about a second roller axis, the second roller configured to selectively engage and disengage the section of tubing and roll along a surface of the tubing as the rotor rotates;

an encoder, configured to monitor the position of the first and second rollers as the rotor rotates about the axis; and a rotor controller in electrical communication with the encoder and configured to control the operation of the pump and the rotor, the rotor controller configured to receive a stop command, wherein the stop command instructs the rotor controller to stop the peristaltic pump only after (i) receiving the stop command and (ii) determining that either the first or second roller is in the fully engaged position.

24. A peristaltic pump according to claim 23, further comprising a platen, the section of tubing located between the platen and the first roller when the first roller engages the section of tubing, the first roller pressing the section of tubing against the platen thereby occluding the tubing as first roller rolls along the surface of the tubing.

25. A peristaltic pump according to claim 24, wherein the section of tubing is located between the platen and the second roller when the second roller contacts the section of tubing, the second roller pressing the section of tube against the platen thereby occluding the tubing as second roller rolls along the surface of the tubing.

26. A peristaltic pump according to claim 23, further comprising a drive shaft mechanically coupling the rotor and a rotor motor, the encoder located on the drive shaft.

27. A method comprising:

providing a peristaltic pump, the peristaltic pump having: a pump body, a rotor configured to rotate about an axis, a first roller mounted on a first end of the rotor, a second roller mounted on a second end of the rotor, the rotor having no more than two rollers;

inserting a section of tubing into the peristaltic pump;

rotating the rotor about the axis, rotation of the rotor causing the first roller to transition between a disengaged, initially engaged and a fully engaged position with respect to the section of tubing and the second roller to transition between a disengaged, initially engaged and a fully engaged position with respect to the section of tubing, wherein the second roller is in the disengaged position when the first roller is in the fully engaged position, and the first roller is in the disengaged position when the second roller is in the fully engaged position;

monitoring by a pump controller, using an encoder, the position of the first and second rollers as the rotor rotates about the axis;

receiving a stop command by the pump controller, wherein the stop command instructs the pump controller to stop the peristaltic pump; after receiving the stop command, determining by the pump controller whether the monitored position of either the first or second roller is in the fully engaged position;

if it is determined that the monitored position of neither the first nor second roller is in the fully engaged position, re-determining by the pump controller whether the monitored position of either the first or second roller is in the fully engaged position; and if it is determined that the monitored position of either the first or second roller is in the fully engaged position, stopping the pump, using the pump controller.

* * * * *